US007000541B2

(12) United States Patent
Yee et al.

(10) Patent No.: US 7,000,541 B2
(45) Date of Patent: Feb. 21, 2006

(54) SYSTEM AND METHOD FOR INTERLEAF SHEET AND/OR PLATE SHEET REMOVAL AND/OR TRANSPORT FOR USE WITH A PRINTING APPARATUS

(75) Inventors: Chang J. Yee, Stow, MA (US); John Berrigan, Nashua, NH (US); James A. Dougherty, Lowell, MA (US)

(73) Assignee: ECRM, Inc., Tewksbury, MA (US)

( * ) Notice: Subject to any disclaimer, the term of this patent is extended or adjusted under 35 U.S.C. 154(b) by 0 days.

(21) Appl. No.: 10/836,601

(22) Filed: May 3, 2004

(65) Prior Publication Data

US 2005/0241516 A1 Nov. 3, 2005

(51) Int. Cl.
*B41F 1/30* (2006.01)

(52) U.S. Cl. ..... 101/408; 101/407.1; 101/477; 414/797

(58) Field of Classification Search ..... 101/407.1–412, 101/415.1, 126, 129, 477; 414/416.07, 752.1, 414/797, 411, 331.1
See application file for complete search history.

(56) References Cited

U.S. PATENT DOCUMENTS

| | | | | |
|---|---|---|---|---|
| 3,947,116 | A | 3/1976 | Dewaele | 355/40 |
| 4,636,064 | A | 1/1987 | Penza et al. | 355/73 |
| 5,045,144 | A | 9/1991 | Bonemi | 156/361 |
| 5,655,452 | A | 8/1997 | Blake et al. | 101/477 |
| 5,746,426 | A | 5/1998 | Nakabayashi et al. | 271/119 |
| 5,788,455 | A | 8/1998 | Krupica et al. | 414/797 |
| 5,791,250 | A | 8/1998 | Blake et al. | 101/483 |
| 5,818,508 | A | 10/1998 | Straayer et al. | 347/262 |
| 5,924,687 | A | 7/1999 | Hannon | 271/116 |
| 5,954,440 | A | 9/1999 | Leys et al. | 400/645 |
| 5,960,247 | A | 9/1999 | Morikawa | 399/382 |
| 5,967,681 | A | 10/1999 | Leys et al. | 400/636 |
| 5,992,324 | A | 11/1999 | Rombult et al. | 101/477 |
| 5,996,991 | A | 12/1999 | Dirx et al. | 271/149 |
| 6,000,337 | A | 12/1999 | Blake et al. | 101/477 |
| 6,044,975 | A | 4/2000 | Dirx et al. | 514/299 |
| 6,113,346 | A | 9/2000 | Blake et al. | 414/811 |
| 6,123,331 | A | 9/2000 | Vackier et al. | 271/233 |
| 6,138,566 | A | 10/2000 | Sakamoto | 101/463.1 |
| 6,313,929 | B1 | 11/2001 | Hatayama | 358/490 |
| 6,336,404 | B1 | 1/2002 | Sakamoto | 101/463.1 |
| 6,530,322 | B1 | 3/2003 | Ono et al. | 101/389.1 |

(Continued)

FOREIGN PATENT DOCUMENTS

JP 07206183 A * 8/1995

(Continued)

OTHER PUBLICATIONS

"Computer-to-plate (CTP)." Mar. 2002. *Fujifilm Electronic Imaging Ltd.* Version 3.

(Continued)

*Primary Examiner*—Minh Chau
(74) *Attorney, Agent, or Firm*—Wilmer Cutler Pickering Hale and Dorr LLP

(57) ABSTRACT

The present invention relates generally to systems and methods that remove an interleaf sheet interposed between plate sheets from a material stack used, for example, in a computer-to-plate imaging system and/or environment. Embodiments of the system and method can also remove plate sheets from an interleaf sheet, and transport the plate sheet for subsequent imaging.

10 Claims, 14 Drawing Sheets

U.S. PATENT DOCUMENTS

| | | | | |
|---|---|---|---|---|
| 6,550,382 | B1 | 4/2003 | Kouyama et al. | 101/171 |
| 6,561,097 | B1 | 5/2003 | Toyofuku | 101/481 |
| 6,607,192 | B1 | 8/2003 | Ono et al. | 271/90 |
| 6,619,208 | B1 | 9/2003 | Ono et al. | 101/477 |
| 6,623,003 | B1 | 9/2003 | Koizumi et al. | 271/270 |
| 6,626,527 | B1 | 9/2003 | Pinard | 347/74 |
| 6,651,561 | B1 * | 11/2003 | Koizumi et al. | 101/477 |
| 6,654,660 | B1 | 11/2003 | Singh et al. | 700/121 |
| 6,675,711 | B1 | 1/2004 | Kawamura et al. | 101/477 |
| 6,675,712 | B1 | 1/2004 | Marincic et al. | 101/477 |
| 6,684,783 | B1 | 2/2004 | Salvestro | 101/401.1 |
| 6,688,591 | B1 | 2/2004 | Larsen et al. | 271/98 |
| 6,726,433 | B1 | 4/2004 | Blake et al. | 414/411 |
| 6,729,837 | B1 | 5/2004 | Ono et al. | 414/797 |
| 6,739,261 | B1 * | 5/2004 | Ono | 101/477 |
| 6,745,694 | B1 * | 6/2004 | Ellis et al. | 101/477 |

FOREIGN PATENT DOCUMENTS

JP 2003012165 A * 1/2003

OTHER PUBLICATIONS

"Plate Imaging with Computer-to-Plate. Expert Guide." Jun. 2002. *Heidelberger Druckmaschinen AG*.

http://www.yet2.com/app/list/techpak?id=11342&sid=90&abc=0&page=tpprint. Printed Sep. 18, 2003.

http://www.vgreed.com/Technology.html. Printed Sep. 18, 2003.

http://www.k-f.com/products/wildcat.html. Printed Sep. 18, 2003.

"PlateRite 8000II/8600. Thermal Plate Recorder." *Screen*.

"WildCat CTP System." *ECRM® Imaging Systems*.

"XL Series Computer Plate." *K&F International*.

Feb. 14, 2005. International Search Report and Written Opinion from PCT Application No. PCT/US04/13572.

Apr. 6, 2005, International Search Report and Written Opinion from PCT Application No. PCT/US04/13572.

* cited by examiner

SYSTEM AND METHOD FOR INTERLEAF SHEET AND/OR PLATE SHEET REMOVAL AND/OR TRANSPORT FOR USE WITH A PRINTING APPARATUS

BACKGROUND OF THE INVENTION

1. Field of the Invention

The present invention relates generally to a system and method for removing and/or separating an interleaf sheet from a plate sheet and/or transporting a plate sheet, used in connection with, for example, Computer-to-Plate (CTP) imaging systems.

2. Background Description

Automating the printing process in CTP imaging systems involves the alternating process of extracting plate sheet material, and then interleaf sheet material, from a material stack. Images are exposed on the plate sheet material, and the interleaf sheet material is used to protect the imaging surface of plate sheets from each other.

Interleaf sheets, though varying from manufacturer to manufacturer in material characteristics such as smoothness, porosity, and color, are generally paper-like with a thickness of about 0.003 inches. Plate sheet material typically varies in thickness from 0.005 inches to 0.012 inches.

Extracting the interleaf sheets manually is labor intensive, but normally does not present other issues or challenges. However, automating the process for extracting interleaf sheets can be challenging. For example, interleaf sheets can adhere onto the imaging surface of the plate sheet because of, for example, friction and/or static. Known CTP systems that automate the removal of interleaf sheets, such as disclosed in U.S. Pat. No. 5,655,452, which is in incorporated herein by reference, use at least a combination of a suction cup and air blast. However, due to the porous nature of the interleaf sheet, reliability issues are generally present when suction cups are used to remove interleaf sheets.

Other known techniques for removing interleaf sheets involve the sole or predominant use of pneumatic techniques, or grippers. For example, gripping can involve the use of two rubber pads that contact an interleaf sheet. The rubber pads are separated before making contact with the interleaf sheet. Subsequent to making contact, the pads are moved closer together, thereby grabbing the interleaf sheet. The pads then lift the interleaf sheet off the stack, and move it to a bin or transport device. The cycle is repeated for each interleaf sheet in the stack. However, the "grabbing" technique has operational and reliability shortcomings.

In addition, the process of removing a plate sheet from an interleaf sheet is difficult to automate. The need is to pick up and remove the plate sheet, without disturbing the position or condition of the interleaf sheet underneath the plate. The interleaf sheet may have vacuum and static electricity forces that cause the interleaf sheet to adhere to the underside of the plate sheet. Conventional systems generally pick up the plate sheet at or near its geometric center. Once the plate sheet is removed from the stack using, for example, suction cups, various sequences of flexing, shaking, air blasting are employed to remove an interleaf sheet that is adhering to the underside of the plate. In the worst case there are multiple plates and interleaf sheets stuck to the top plate. Such conventional systems/mechanisms tend to be relatively large, complicated, and expensive.

SUMMARY OF THE INVENTION

Embodiments of the present invention relates generally to Computer-to-Plate (CTP) imaging systems and, more particularly, to systems and methods for removing and/or separating an interleaf sheet from a plate sheet, and/or transporting the plate sheet for subsequent imaging. Embodiments of the invention advantageously utilize relatively simple motion that simplifies picking up interleaf sheets and/or separating them from plate sheets. Interleaf sheets can then optionally be transferred to a disposal bin. Embodiments of the present invention also advantageously maintain positive control of plate sheets and interleaf sheets throughout the separation and disposal processes.

Embodiments of the invention utilize the same mechanism to pick up and move plate sheets and interleaf sheets. The embodiments advantageously make the apparatus efficient to program, minimize the number of parts, and provide a relatively simple and low cost solution.

One embodiment of the present invention provides a system for removing an interleaf sheet contacting a plate sheet. The system includes a substantially horizontal member, and an assembly that includes at least two elements configured to directly contact and pick up the interleaf sheet. A portion of the assembly is connected to the member. A motor is configured to move the member in a direction substantially perpendicular to a surface of the interleaf sheet as positioned prior to contact. In addition, a sensor system is provided that generates a signal indicating when the member is a first predetermined distance from the interleaf sheet. The motor can utilize the first predetermined distance to move the member a second predetermined distance from the interleaf sheet such that the at least two elements do not contact each other at the second predetermined distance. The motor then moves the member in a direction toward the first predetermined distance, to a position where at least a portion of the interleaf sheet is interposed between the at least two elements.

The at least two elements can be first and second rollers, optionally having a non-circular shape. The first and second rollers do not rotate when the member is moving from the second predetermined distance to the first predetermined distance. The first and second rollers can include (or utilize) clutch bearing to prevent rotation when the member is moving from the second predetermined distance to the first predetermined distance.

In addition, the first element can be a roller, and the second element can be a block, optionally having a recess on a face of the block proximate the roller. The roller does not rotate when the member is moving from the second predetermined distance to the first predetermined distance, and may include, for example, a clutch bearing to prevent the rotation of the roller.

The system may also include or utilize a disposal roller assembly that receives the interleaf sheet from the at least two elements. In addition, a rail assembly can be used that is configured to move the at least two elements to a position where the disposal roller assembly receives the interleaf sheet.

A second sensor system can be used that is configured to stop the rail assembly at the position where the disposal roller assembly receives the interleaf sheet. In addition, a third sensor system can be used that is configured to indicate when the member is in a home position. A second motor can be used that is configured to move the member in a direction that is substantially perpendicular to a direction in which the plate sheet is fed into the imaging system.

Yet another embodiment of the invention that can be used to remove an interleaf sheet contacting a plate sheet used in an imaging system includes a roller carriage that includes a first roller and a second roller rotating in opposing directions. The first and second rollers can contact the interleaf sheet, and transport the interleaf sheet between the first and second rollers. A rail system can be used that is configured to move the roller carriage in a direction substantially perpendicular to a surface of the interleaf sheet as positioned prior to contact. In addition, a transfer housing can be used that includes at least one driven roller and a corresponding non-driven roller to receive the interleaf sheet from the roller carriage.

A motor and belt can be used that are configured to drive the driven roller. A sensor system can be used that stops the first and second rollers from rotating when a predetermined length of the interleaf sheet passes between the first and second rollers. Another sensor system may be utilized to stop the at least one driven roller from rotating substantially simultaneous with or subsequent to a time when, for example, a trailing edge of the interleaf sheet has cleared a last roller of the at least one driven roller.

Another embodiment of the invention consists of an apparatus for lifting a sheet of paper or a paper-like sheet. The apparatus includes a first X-shaped member having a first beam and a second beam of substantially equal length and rotatably connected to each other, and a second X-shaped member having a first beam and a second beam of substantially equal length and rotatably connected to each other. A rod having opposing ends is connected to the first and second X-shaped members.

A first roller has an axle extending therethrough, and opposing ends of the axle contact the first beams, and a second roller has an axle extending therethrough, with opposing ends of the axle contacting the second beams. A first connecting rod having opposing ends contacts the first beams, and a second connecting rod having opposing ends contacts the second beams. At least one spring is connected to the first and second connecting rods, such that the at least one spring provides a pinch force that holds a surface of the first and second rollers in contact at an equilibrium position. The first and second rollers rotate about their respective axles when moving apart from each other, and do not rotate about their respective axles when moving towards each other. The non-movement of the first and second rollers provides a friction force with respect to the sheet, causing a portion of the sheet to be interposed between roller surfaces when the first and second rollers return to the equilibrium position.

When a push rod contacts the rod and moves in a downward direction, the rollers move apart from each other. The first and second rollers may include or utilize clutch bearings to prevent rotation of the first and second rollers when the first and second rollers are moving towards each other. The first and second beams of each of the first and second X-shaped members are optionally connected to each other at a midsection of each of the first and second X-shaped members.

Another embodiment of the invention that can be used to lift a sheet of paper or a paper-like sheet includes a first X-shaped member that includes a first beam and a second beam of substantially equal length and rotatably connected to each other. A second X-shaped member can also include a first beam and a second beam of substantially equal length and rotatably connected to each other. A rod having opposing ends may be connected to the first and second X-shaped members. A roller has an axle extending therethrough, such that opposing ends of the axle are connected to the first beams. A block can be interposed between each of the second beams. A first connecting rod can have opposing ends that respectively contact the first beams, and a second connecting rod can have opposing ends that respectively contact the second beams. At least one spring can be connected to the first and second connecting rods, and provide a pinch force that holds a surface of the roller in contact with a surface of the block proximate the roller in an equilibrium position.

The roller can rotate about the axle when moving away from the block, and not rotate about the axle extending therethrough when moving towards the block. The block can optionally have a recess on a face of the block proximate the roller. The non-rotation of the roller provides a friction force with respect to the sheet, causing a portion of the sheet to be interposed between the roller and the surface of the block proximate the roller when the roller returns to the equilibrium position. The roller may include or utilize clutch bearings to prevent rotation of the roller when the roller moves toward the block.

A rod can extend through the block structure such that opposing ends of the rod respectively contact the second beams. A push rod can be utilized such that movement of the push rod in a downward direction causes the roller to move away from the block. The first and second beams of each of the first and second X-shaped members can be connected to each other at a midsection of each of the first and second X-shaped members.

A method in accordance with the invention removes an interleaf sheet contacting a plate sheet used in an imaging system. A substantially horizontal member is provided, and an assembly is provided that has at least two elements configured to directly contact and pick up the interleaf sheet. A portion of the assembly is connected to the member.

The member is moved in a direction substantially perpendicular to a surface of the interleaf sheet as positioned prior to the at least two elements contacting the interleaf sheet. A signal is generated that indicates when the member is a predetermined distance from the interleaf sheet. The first predetermined distance can be used to move the member to a second predetermined distance from the interleaf sheet, so that the at least two elements are not contacting each other at the second predetermined distance. Then, the member can be moved in a direction toward the first predetermined distance to a position where at least a portion of the interleaf sheet is held between the at least two elements.

The elements can be rollers, optionally having a non-circular shape. Alternatively, the first element can be a roller, and the second element can be a block optionally having a recess on a face of the block proximate the roller. The method can also include transporting the two elements to an interleaf sheet disposal mechanism, and conveying the interleaf sheet from the at least two elements to the disposal mechanism.

Still another embodiment of the present invention provides a system for removing a plate sheet contacting an imaging sheet. The system includes a substantially horizontal member, and an assembly that includes at least one element configured to directly contact and pick up the plate sheet. A portion of the assembly is connected to the member. A motor is configured to move the member in a direction substantially perpendicular to a surface of a plate sheet as position prior to contact. In addition, a sensor system is provided that generates a signal indicating when a member is a predetermined distance from the plate sheet. The element can then engage the plate sheet, and the motor moves the member away from the plate stack.

The element can be one or more vacuum cups. When the vacuum cup(s) is at the first predetermined position, and the vacuum is turned on, the vacuum causes the plate to adhere to the vacuum cup(s).

The system can use a rail system that is configured to move the plate sheet either forward (horizontally) to the imaging system or backward (horizontally) from the position that the member first contacted the plate. This motion of the plate sheet is substantially parallel to the surface of the interleaf sheet. The rail system can move the plate sheet a small distance backward (horizontally) simultaneous with moving the plate surface vertically away from the interleaf sheet. This movement can result in zero (or substantially no) net motion of the underside of the plate surface relative to the contacting interleaf sheet surface. If the interleaf sheet initially adheres to the underside of the plate sheet surface, in the absence of any other forces (e.g., static) the interleaf sheet will fall back from the underside of the plate sheet surface and return to its original position in the plate-interleaf sheet stack.

The system can use a manifold to direct compressed air against the underside of the plate sheet surface. An on/off valve or a variable flow valve, for example, turns the compressed air on/off. The variable flow valve can set the appropriate amount of flow for a particular size and/or thickness of a plate sheet. The compressed air can be enabled, for example, when the edge of the plate sheet is raised up from the plate-interleaf stack and the underneath interleaf sheet has returned to plate sheet stack surface. The manifold can direct the air-flow so that the plate sheet raises away from the underneath interleaf sheet on a cushion of air. The rail system may then move the plate sheet toward the imaging system. Movement of the plate sheet is essentially parallel to the interleaf sheet. The cushion of air ensures that the plate sheet moves without disturbing the interleaf sheet.

The system can direct the compressed air through an ionizer on its path to the underside surface of the plate sheet. The negatively and positively ionized air discharges any positive or negative static charge that develops between the insulating interleaf sheet and the conductive plate sheet. This ensures that no static force exists to cause the interleaf sheet to adhere to the underside of the plate sheet.

BRIEF DESCRIPTION OF THE DRAWINGS

The Detailed Description including the description of preferred structures as embodying features of embodiments of the invention will be best understood when read in reference to the accompanying figures wherein.

DETAILED DESCRIPTION OF A PREFERRED EMBODIMENT OF THE INVENTION

Figure 1:
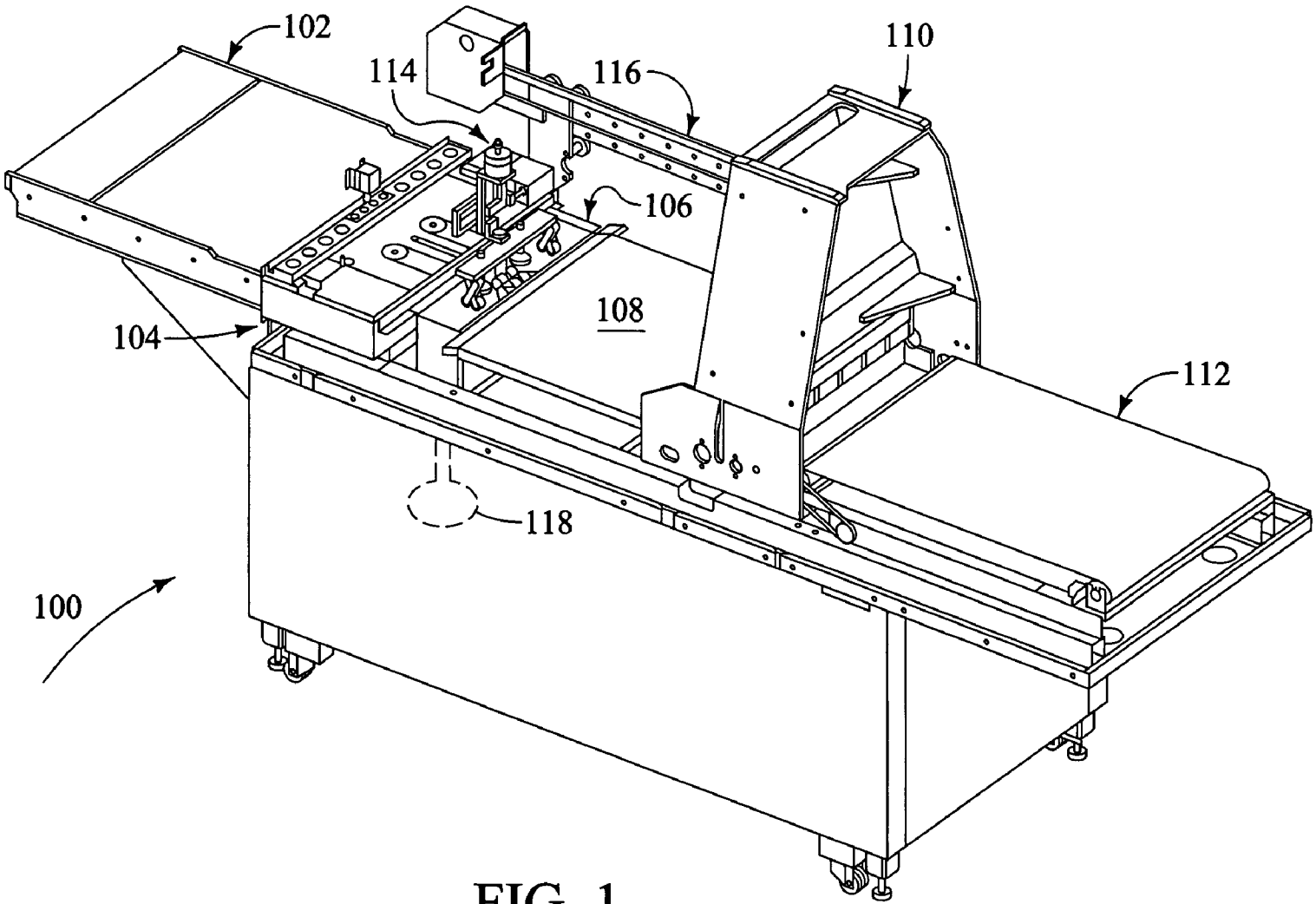
FIG. 1 is a perspective view of a Computer-to-Plate (CTP) imaging system, also showing an exemplary embodiment of an interleaf sheet removal and plate sheet transport apparatus.

FIG. 1, generally at 100, is a perspective view of a Computer-to-Plate (CTP) imaging system that can be used in connection with the interleaf sheet removal and plate sheet transport apparatus 114 (apparatus 114) and/or portions thereof in accordance with embodiments of the present invention. The system 100 includes a cassette assembly 102 that can hold plate sheets (not shown) and associated interleaf sheets (not shown). Cassette interface 104 can be used to load the cassette assembly 102 with alternating plate sheets and interleaf sheets in a conventional manner. Apparatus 114 can be used to remove interleaf sheets from plate sheets, remove plate sheets from interleaf sheets, dispose the interleaf sheets in funnel assembly 106, and/or transport plate sheets to input shelf 108. Vacuum pump 118 is used to generate a suction so that suction cups can hold and transport a plate sheet. When the plate sheets are received at input shelf 108, imaging apparatus 110 generally utilizes one or more lasers to perform plate sheet imaging in a conventional manner. Output platform 112 receives imaged plate sheets.

Figure 2:
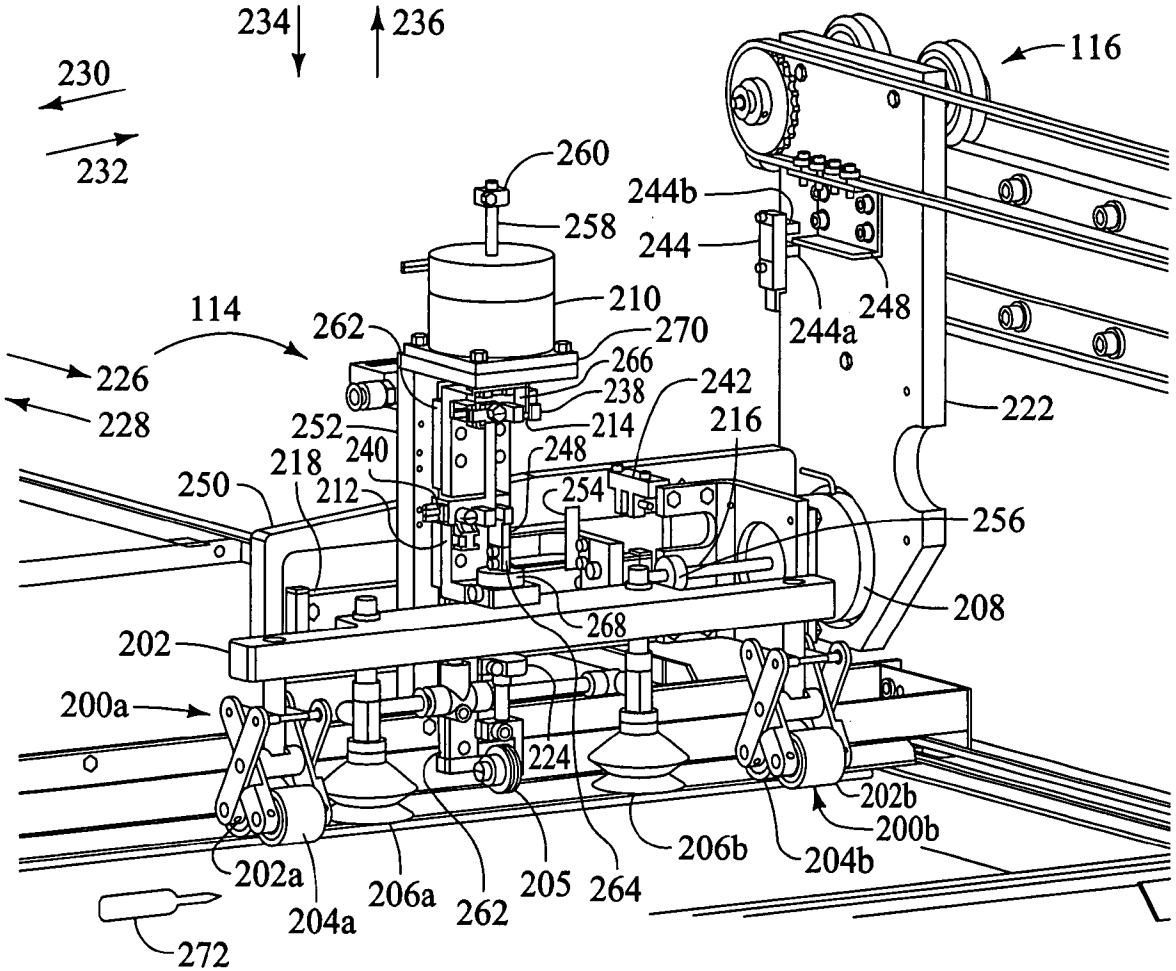
FIG. 2 is a perspective view of an exemplary interleaf sheet removal and plate sheet transport apparatus.
Figure 3:
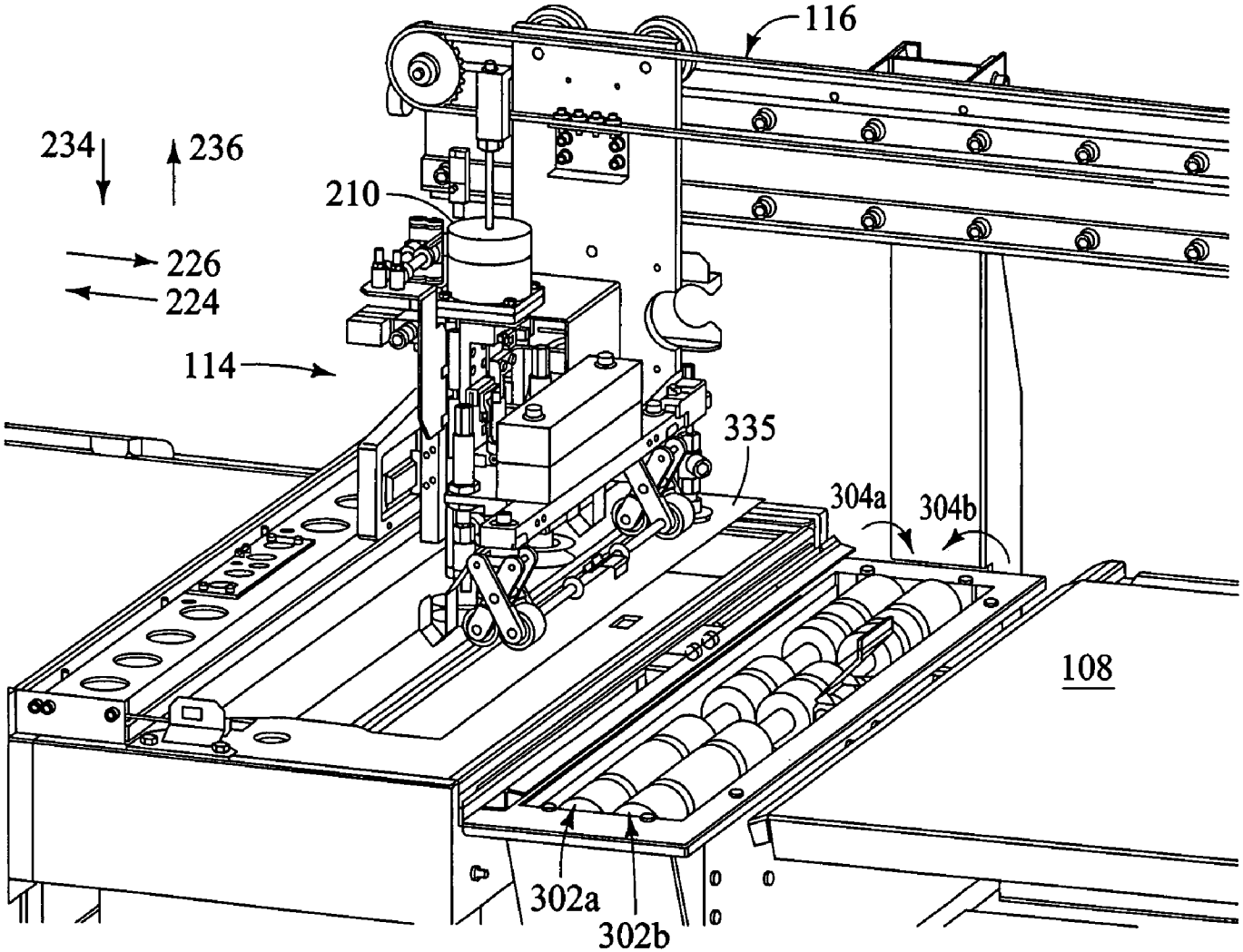
FIG. 3 is a second perspective view of the exemplary interleaf sheet removal and plate sheet transport apparatus, and disposal rollers.

FIGS. 2 and 3 show perspective views of apparatus 114. Apparatus 114 includes member 202, which can be used to receive a portion of roller assemblies 200*a*, 200*b*. Roller assemblies 200*a*, 200*b* can be used to pick up and remove interleaf sheets, as will be described below. Member 202 can also be used to receive a portion of suction cups 206*a*, 206*b*. Suction cups 206*a*, 206*b* can be used to pick up and remove plate sheets 335, and feed (transport) them to input shelf 108 and imaging apparatus 110. Prior to roller assemblies 200*a*, 200*b* picking up an interleaf sheet, an interleaf sheet will be substantially horizontal, as plate sheet 335 is shown in FIG. 3.

Rail apparatus 116 can be used to move apparatus 114 in the direction of arrows 226, 228. Optical sensor 244, which can be mounted in a fixed position, and having teeth 244*a*, 244*b*, can be used to control movement of apparatus 114. Flag 248 can be received between teeth 244*a*, 244*b* to block an optical signal between the teeth. When the optical circuit is completed between teeth 244*a*, 244*b*, movement in direction 226, 228 can be stopped. Optical sensors 238, 240, and 242 can be configured the same as or similarly to sensor 244 to control movement and/or position, as will be described herein.

Rail apparatus 116 can include a mounting plate 222 which, in turn, is secured to member 250. Motor 208 is used to drive shaft 216 which, in turn, moves apparatus 114 in the direction of arrows 230, 232. Shaft 216 can be, for example, a conventional screw shaft. Member 250 can be attached to or be an integral part of mounting plate 222. Horizontal slide rail 218 can be attached to or an integral part of member 250. Vertical plate 252 can have an attachment or integral part thereof that mates with and receives horizontal slide rail 218 to facilitate movement of apparatus 114 in the direction of arrows 230, 232. The length of shaft 216 and/or collar 256 contact with member 202 can be used to limit movement of apparatus 114 in the direction of arrow 230. Flag 254 and sensor 242 are used to limit movement of assembly in the direction of arrow 232.

Sensor 238 may used to indicate that member 212 is at or near a home position. Flag 266 is attached to or integral with, for example, a bottom surface of motor mount 270. When member 212, having sensor 240 attached thereto, moves in the direction of arrow 236, a home position can be determined when flag 266 cuts of the signal between the teeth of sensor 238. In FIG. 2, member 212 is shown in the home position.

Motor 210 is used to drive shaft 258 which, in turn, moves apparatus 114 in the direction of arrows 234, 236. Shaft 258 may be, for example, a conventional screw shaft. Vertical position member 212 can have an attachment or integral part thereof that mates with and receives vertical slide rail 262 to facilitate movement of apparatus 114 in the direction of arrows 234, 236. Flag 248 and sensor 240 are used to determine the distance of member 202 from an interleaf sheet or plate sheet 335. The length of shaft 258 and/or collar 260 contact a top surface of motor 210, and is used to limit movement of apparatus 114 in the direction of arrow 234.

Plate height sensor member 205 can be used to determine the distance of member 202 from an interleaf sheet or a plate sheet 335. When sensor 204 contacts an interleaf sheet or plate sheet 335, member 202 continues to move in the direction of arrow 234, and shaft 264 will move in the direction of arrow 236. Flag 248 can be attached to or integral with a top portion of shaft 248, such that as member 202 continues to move in the direction of arrow 234, flag 248 will block the optical signal of sensor 240. The blocking of the optical signal can be associated with a distance of member 202 to an interleaf sheet or plate sheet 335.

In the case of an interleaf sheet, motor 210 continues to drive member 202 in the direction of arrow 234, and thereby activate roller assemblies 200*a*, 200*b*, as will be described herein. Movement of member 202 in the direction of arrow 234 is limited by collar 224 contacting a bottom surface of member 202 and/or collar 260 contacting a top surface of motor 210. After an interleaf sheet is received between rollers 202*a*, 204*b* and 202*b*, 204*b*, motor 210 is used to raise apparatus 114 in the direction of arrow 236.

When apparatus 114 removes an interleaf sheet, rail apparatus 116 can the be activated to move apparatus 114 in the direction of arrow 226, to position the interleaf sheet over disposal rollers 302*a*, 302*b*. Disposal rollers can be driven by at least one motor and belt assembly (not shown) to rotate rollers 302*a*, 302*b* respectively in the direction of arrows 304*a*, 304*b*. Motor 210 can be used to lower apparatus 114 in the direction of arrow 234 so that the interleaf sheet contacts the disposal rollers 302*a*, 302*b* and conveys the interleaf sheet to rollers 302*a*, 302*b*. Upon disposing of the interleaf sheet, motor 210 can be used to raise apparatus 114 in the direction of arrow 236. Rail apparatus 116 can be used to move apparatus 114 in the direction of arrow 228, so that suction cups 206*a*, 206*b* can pick up a plate sheet 335, and feed the plate sheet 335 to input shelf 108 for subsequent imaging.

In the case of a plate sheet 335, vacuum pump 118, operatively connected to suctions cup 206*a*, 206*b* by, for example, one or more hoses, is activated. The suctions cups 206*a*, 206*b*, by vacuum, hold the plate sheet 335 in contact with the vacuum cups 206*a*, 206*b*. Movement of member 202 in the direction of arrow 234 is again limited by collar 224 contacting a bottom surface of member 202 and/or collar 260 contacting a top surface of motor 210. After an interleaf sheet is received between rollers 202*a*, 204*b* and 202*b*, 204*b*, motor 210 can be used to raise apparatus 114 in the direction of arrow 236.

Once the suction cup 206*a*, 206*b* contact a plate sheet 335, in one embodiment of the invention, the following sequential, non-sequential or sequence independent operations may take place. Referring to FIG. 1, assembly 114 is moved in proximity to an edge of the plate sheet 335. An edge of the plate sheet 335 is preferred because static forces and vacuum forces are generally weaker there. Vacuum pump 118 is activated to provide a vacuum to suction cups 206*a*, 206*b*. Apparatus then moves in the direction of arrow 236, thus lifting plate sheet 335. In one embodiment, the plate sheet 335 can be lifted approximately 10 mm.

The plate sheet 335 is held in the raised (in the direction of arrow 236) position for approximately 3–5 seconds, thereby allowing an interleaf sheet that may be adhering to a bottom surface of the plate sheet 335, in the vast majority of cases, to separate and fall back in to place to the stack. The interleaf may not fall/separate from the bottom of the plate sheet 335 in all instances. To minimize any relative motion between the interleaf sheet and the plate sheet 335 under these circumstances, apparatus 114, holding plate sheet 335, moves further in the direction of arrow 236, and slightly in the direction of arrow 228 to minimize or eliminate any sliding of the plate sheet 335 relative to the interleaf sheet underneath the plate. Relative motion may be caused by sagging at the opposing end of the plate sheet 335 from which the suction cups 206*a*, 206*b* are holding the plate sheet 335. The sagging causes the opposing end of the plate sheet 335 to drop vertically. The opposing edge of the plate sheet 335, by virtue of dropping vertically, also moves slightly toward suction cups 206*a*, 206*b* (in the direction of arrow 226), which is compensated for by the apparatus 114 moving in the direction of arrow 228.

Whether or not the interleaf sheet has dropped back to the stack or adheres to the bottom of the plate sheet 335, ionizer 272 is activated, which creates an air cushion. A compressed air cylinder (not shown) may be used in conjunction with ionizer 272, which causes static charges to dissipate. Any interleaf sheet that may have been adhering to the bottom of the plate sheet 335 will now fall back to the stack. In either case, static charges will be dissipated. Ionizer 272 can be operated for approximately 5 seconds to dissipate any static charges. Rail 116 is then engaged to move apparatus 114 and the plate sheet 335 in the direction of arrow 226, thereby moving the plate sheet 335 along the air cushion, and on to the input shelf 108 where the plate sheet 335 is positioned and released for imaging.

Figure 4:
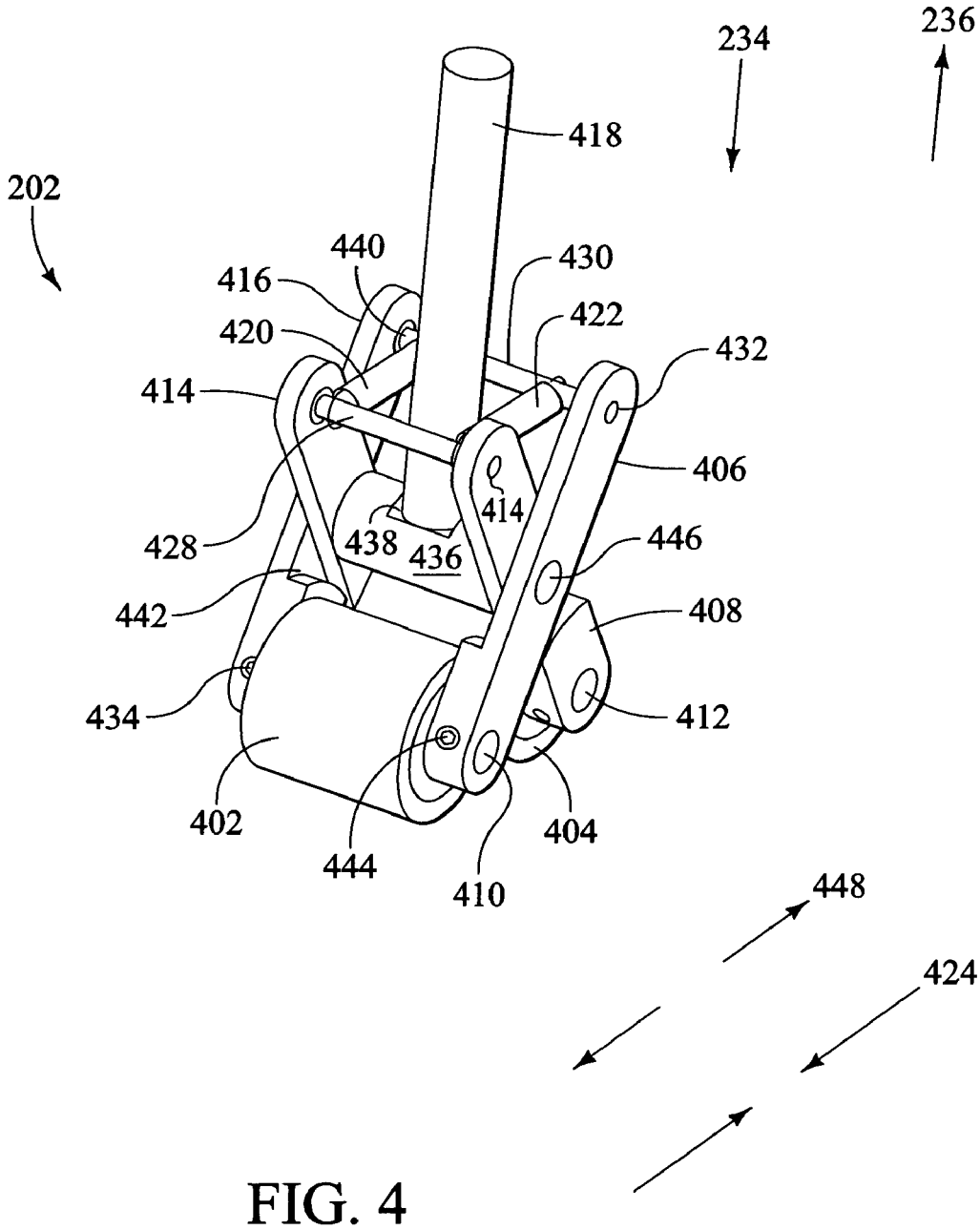
FIG. 4 is a perspective view of an exemplary embodiment of an interleaf sheet removal roller apparatus.

FIG. 4, generally at 202, is a perspective view of an exemplary embodiment of an interleaf sheet roller assembly. Rollers 402, 404 can be provided with roller clutch bearings. The surface of rollers 402, 404 is preferably made of a rubber or rubber-like material suitable for gripping interleaf sheets. Urethane or a urethane-like material can be used.

Axles, preferably made of urethane, are respectively received in holes 410, 412 of members 406, 408. The axles are also similarly received in corresponding holes (not shown) of members 414, 416. Members 406, 408 and 414, 416 rotate about hinge pin 446. Members 406, 408 and 414, 416 are respectively arranged in a scissors-like configuration. A recess 442 can be provided on members 406, 416 to limit the movement of members 408, 414 as the bottom portion of members 406, 408, 414, 416 move in the direction of arrows 448. Screws 444 can be provided on members 406, 408, 414, 416 to hold the axles in place so that they do not rotate relative to members 406, 408, 414, 416. In this manner, roller clutch bearings (not shown) can be used to prevent rotation of rollers 402, 404 when rollers 402, 404 move towards each other, in the direction of arrows 424.

Member 436 and hinge pin 446 form a single piece. Rod 418 is operably connected and/or in contact with a cutout surface 438 of member 436 and hinge pin 446 such that when rod 418 is pushed in the direction of arrow 234, member 435 and hinge pin 446 can distribute the force to members 406, 408, 414, 416, thereby causing members 406, 408, 414, 416 to move in the direction of arrows 448.

Members 406, 408 are respectively provided with holes 432, 434. Members 414, 416 are provided with similar holes (not shown). Member 406 and its respective hole 432, and member 416 having a respective hole (not shown), receive link 430. Similarly, member 408 and its respective hole 434, and member 414 having a respective hole (not shown) receive link 428. One or more retaining rings 440 can be used to secure links 428, 430 to respective members 408, 414 and 406, 416. Springs 420, 422 are secured to links 428, 430 to provide a force in the direction of arrows 424. The force increases as rollers 402, 404 move in the direction of arrows 448. At equilibrium, springs 420, 422 can provide a force in the direction of arrows 424 such that rollers 402, 404 contact each other with some amount of pinch force.

Figure 5A:
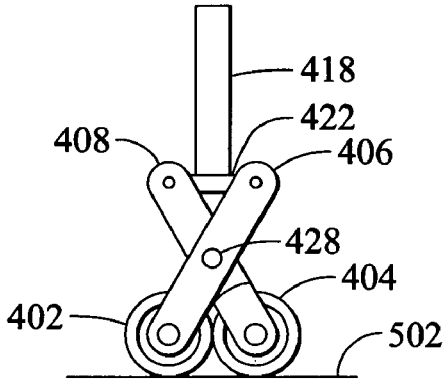
FIGS. 5A–5D is a sequence of operations showing how the interleaf sheet removal roller apparatus can be used to pick up an interleaf sheet.
Figure 5B:
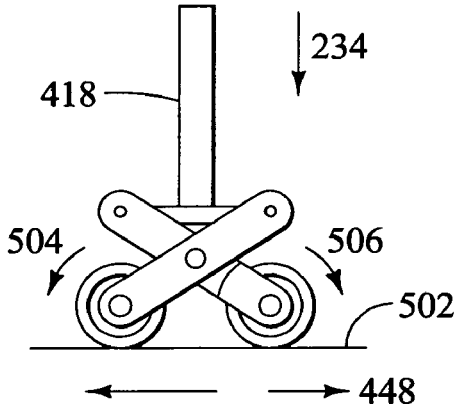

FIGS. 5A–5D show a sequence of positions of assembly 200 with respect to interleaf sheet 502. FIG. 5A shows rollers 402, 404 contacting each other with some amount of pinch force, and contacting interleaf sheet 502. In FIG. 5B, a force is applied to rod 418 in the direction of arrow 234, causing rollers 402, 404 to press outward in the direction of arrows 448.

Rollers 402, 404 rotate freely with minimal bearing friction when moving in the direction of arrows 448. When moving in the direction of arrows 448, rollers 402, 404 contact interleaf sheet 502, and can produce a constant or variable contact force.

Figure 5C:
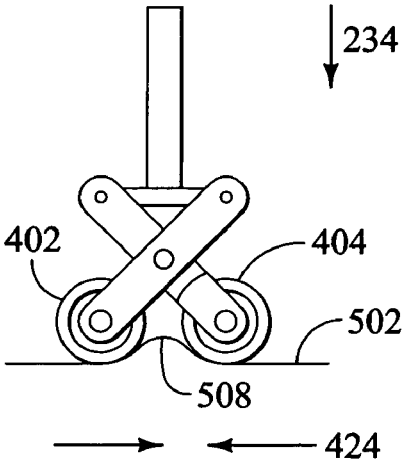

At a point where the outward spacing of the rollers is sufficient to grasp interleaf sheet 502 as shown in FIG. 5C at 508, the forces on the rollers are changed such that rollers 402, 404 maintain a downward force on interleaf sheet 502, while causing rollers 402, 404 to move toward each other in the direction of arrows 424.

Figure 5D:
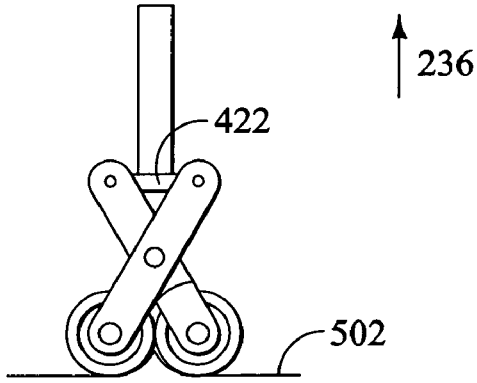

When rollers move in the direction of arrows 424, they are not free to roll on interleaf sheet 502. In an embodiment, standard clutch bearings (not shown) coupled to rollers 402, 404 in a conventional manner can be used to provide unidirectional rotation of the rollers 402, 404 respectively in the direction of arrows 504, 506, and prevent rollers 202, 204 from rotating when they move in the direction of arrows 424. Because rollers 402, 404 do not rotate when they move in the direction of arrows 424, interleaf sheet 502 "buckles up" into a small loop, as shown at 508 in FIG. 5C. The force of rollers 402, 404 against interleaf sheet 502, together with the friction force created by the surface of rollers 402, 404 with respect to interleaf sheet 502, overcome resisting forces between interleaf sheet 502 and the plate sheet below (not shown). Resisting forces may include, for example, the column strength of interleaf sheet 502, static, suction, and/or frictional forces between interleaf sheet 502 and the plate sheet below. As shown in FIG. 5D, springs 420, 422 (spring 420 is not shown in FIG. 5D) pull rollers 402, 404 in the direction of arrows 424 until the rollers 402, 404 provide a pinch force that holds interleaf sheet 502 therebetween.

Figure 6B:
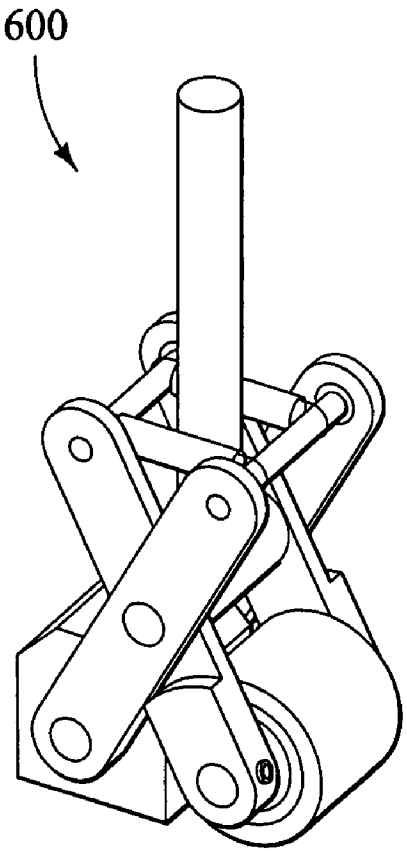
FIG. 6B is a perspective view of a second embodiment of an interleaf sheet removal roller apparatus.
Figure 6A:
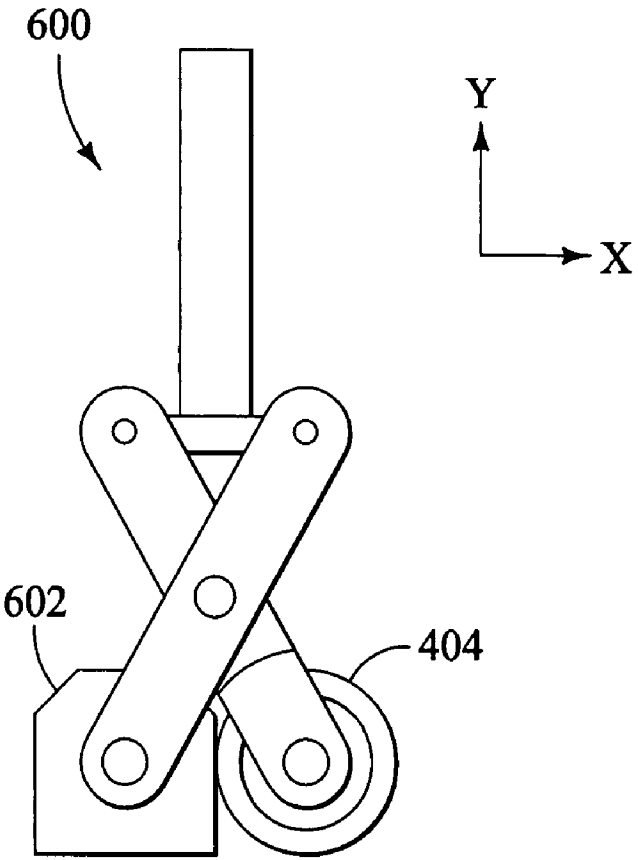
FIG. 6A is a front view of a second embodiment of an interleaf sheet removal roller apparatus.

FIGS. 6A and 6B, generally at 600, respectively show a front view and perspective view of another embodiment of the invention. In particular, FIGS. 6A and 6B shows stationary foot (or thick block) 602, which can be used in lieu of roller 402 shown in FIG. 4. The positions of stationary foot 602 and roller 404 can also be switched. With the embodiment of FIGS. 6A and 6B, curvilinear motion of rod 418 in the x-y plane replaces the simple linear motion of rod 418 in the direction of arrows 234, 236 in the embodiments of FIGS. 4 and 5A–5D.

Figure 7B:
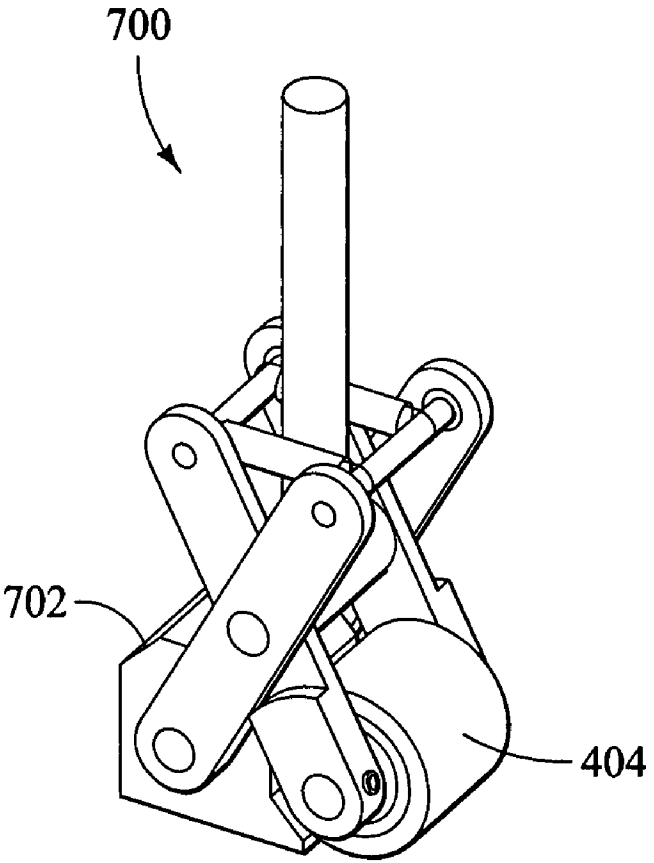
FIG. 7B is a perspective view of a third embodiment of an interleaf sheet removal roller apparatus.
Figure 7A:
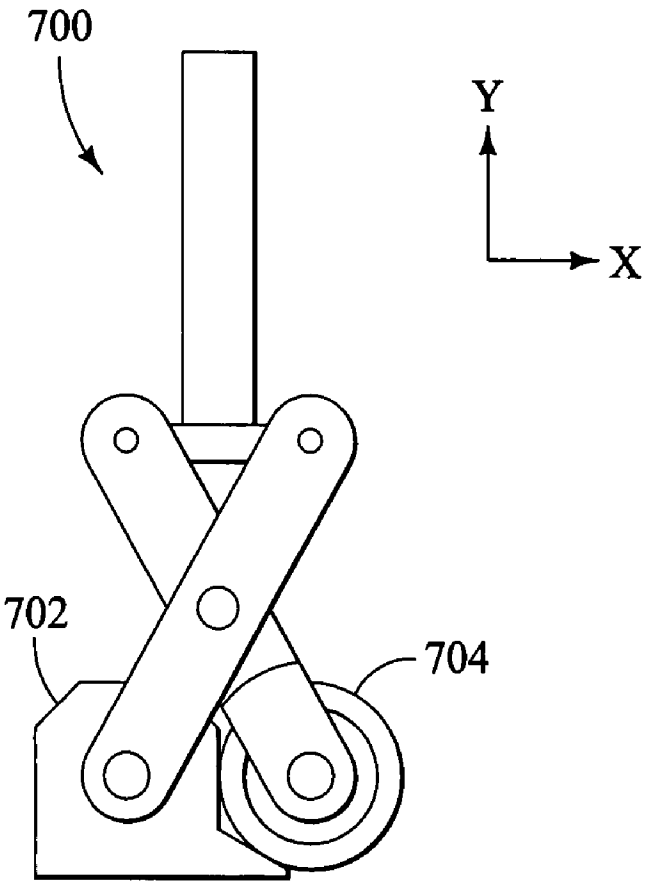
FIG. 7A is a front view of a third embodiment of an interleaf sheet removal roller apparatus.
Figure 8A:
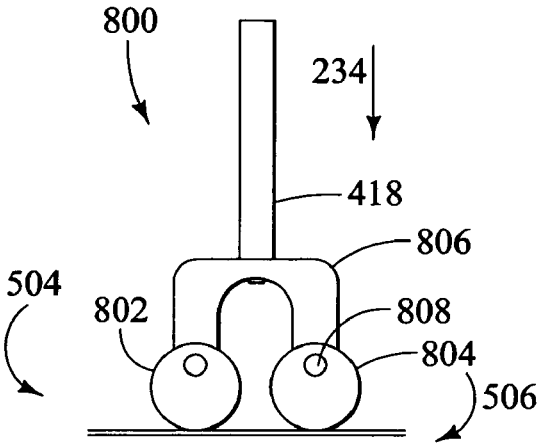
FIGS. 8A–8D is a sequence of operations showing how a fourth embodiment of an interleaf sheet removal roller apparatus can be used to pick up an interleaf sheet.
Figure 8B:
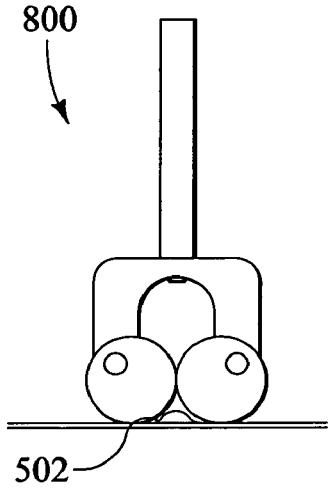
Figure 8C:
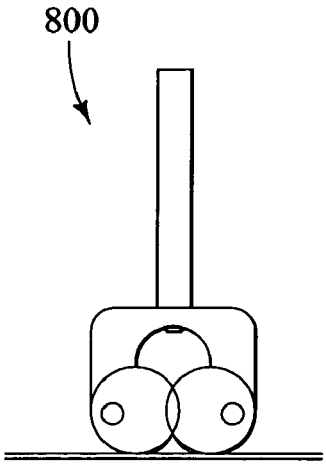
Figure 8D:
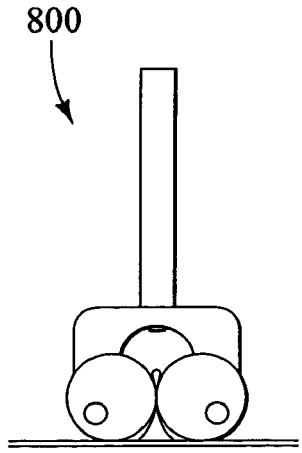

FIGS. 7A and 7B, generally at 700, respectively show a front view and perspective view of another embodiment of the invention. In particular, FIGS. 7A and 7B shows stationary foot (or thin block) 702, which is used in lieu of roller 402 shown in FIG. 4. The positions of stationary foot 702 and roller 704 can also be switched. With the embodiment of FIGS. 7A and 7B, curvilinear motion of rod 418 in the x-y plane replaces the simple linear motion of rod 418 in the direction of arrows 234, 236 in the embodiments of FIGS. 4 and 5A–5D.

FIGS. 8A–8D, generally at 800, shows another embodiment of the invention, and a sequence of positions of assembly 800 with respect to interleaf sheet 502. FIGS. 8A–8D show a substantially rigid Y-shaped link 806, and non-circular rollers 802, 804 with one-way rolling respectively in the direction of arrows 504, 506 when a force is applied to rod 418 in the direction of arrow 234. The embodiment of FIG. 8 can be used to create a cam-like pinch force with respect to interleaf sheet 502. Rollers 802, 804 can be weighted and/or rolled about an axis offset from the axis of the main curvature of the roller. Roller clutch bearings (not shown) can also optionally be used with rollers 802, 804 to prevent rollers 802, 804 from respectively rotating in a direction opposite arrows 504, 506.

Figure 9:
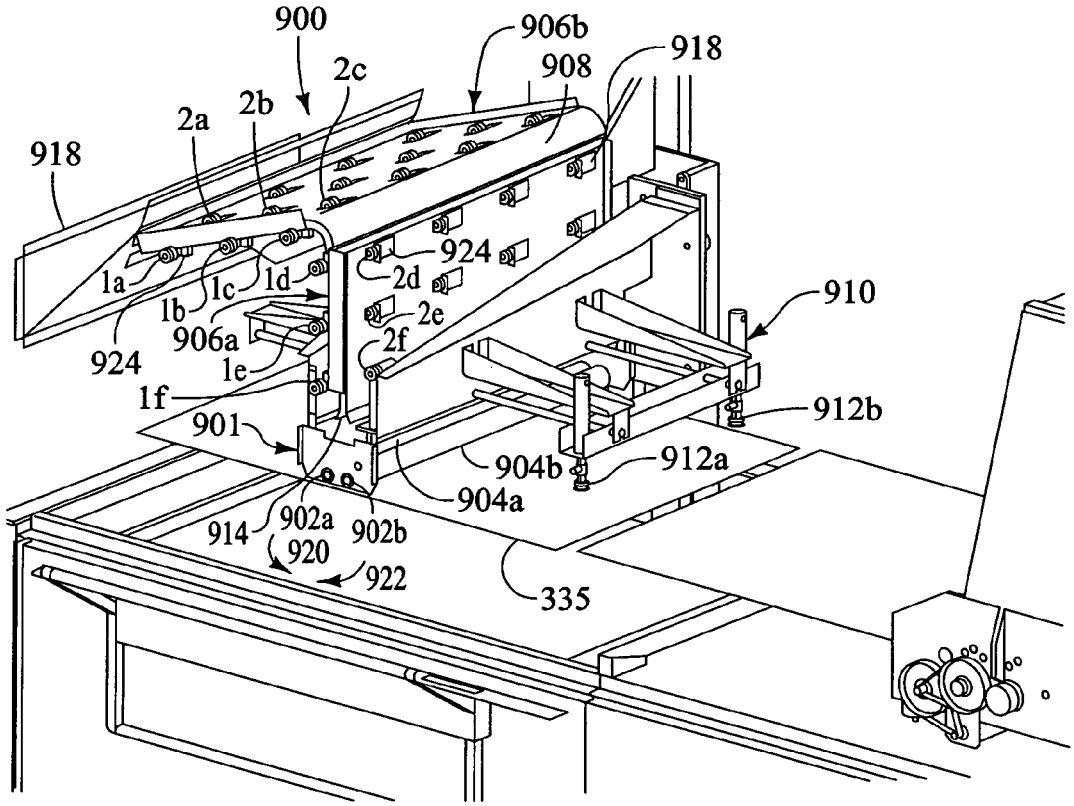
FIG. 9 is a perspective view of a second embodiment of an exemplary interleaf sheet removal apparatus.

FIG. 9, generally at 900, is a perspective view of second embodiment of an exemplary interleaf sheet removal apparatus. Pick up roller carriage 901 can include axles 902*a*, 902*b*. Rollers 904*a*, 904*b* can be configured concentrically about axles 902*a*, 902*b*, and rotate therewith. Rollers 904*a*, 904*b* can be positioned at or near the center of plate sheets 335 and interleaf sheets, and contact each other to facilitate removal of plate sheets 335 and interleaf sheets. One or more motors (not shown) can be used to drive the axles 902*a*, 902*b* respectively in the direction of arrows 920, 922.

Transfer housing 906*a* and 906*b* can be connected to or integral with connection housing 908. An optionally tapered opening 914 can be provided at an end of transfer housing 906*a* to receive interleaf sheets from pick up roller carriage 901. One or more driven rollers 1*a*–1*f* can be mounted to or integral with a first side of transfer housing 906*a*, 906*b*. Rollers 1*a*–1*f* can be driven by a motor and belt (not shown). One or more blocks 924 can be connected to or integral with the first side of tranfer housing 906*a*, 906*b*, and rollers 1*a*–1*f* can be connected to or integral with the respective blocks.

One or more non-driven rollers 2*a*–2*f* can be mounted to or integral with a second side of transfer housing 906*a*, 906*b*. Rollers 1*a*–1*f* can contact rollers 2*a*–2*f* so that rollers 2*a*–2*f* rotate with driven rollers 1*a*–1*f*. A block 926 can be connected to or integral with the second side of tranfer housing 906*a*, 906*b*, and rollers 2*a*–2*f* can be connected to or integral with the respective blocks.

A suction cup apparatus, generally at 910, can optionally be provided and/or utilized in connection with interleaf sheet removal apparatus 900. Suction cups 912*a*, 912*b* can be used to pick up plate sheets 335. Egress chute 918 can have a first end that receives interleaf sheets from transfer housing 906*b*, and a second end that allows the interleaf sheets to exit.

Figure 10:
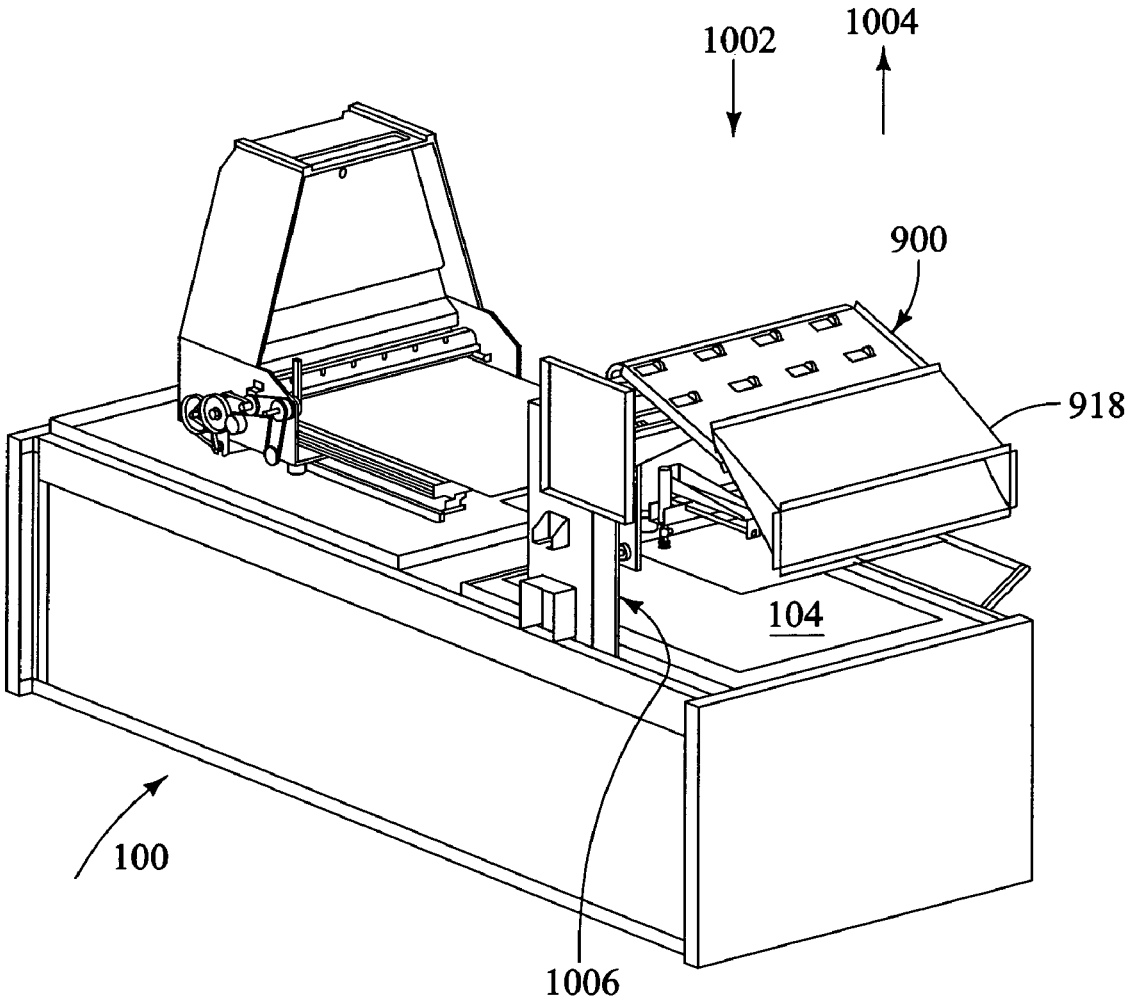
FIG. 10 is a second perspective view of a second embodiment of an exemplary interleaf sheet removal apparatus.

FIG. 10, generally at 900, is a second perspective view of the second embodiment of an interleaf sheet removal apparatus. Rail system 1006 can be used to move pick up roller carriage 901 in the direction of arrows 1002, 1004.

FIGS. 11A–11D is a sequence of operations showing how apparatus 900 can be used to pick up an interleaf sheet. Pick up roller carriage 901 is positioned near plate sheet and interleaf sheet stack 1102. Rollers 904*a*, 904*b*, resting on an interleaf sheet, respectively rotate in the direction of arrows 914, 916 to remove an interleaf sheet 1104 from stack 1102.

A disposal bin 1110 can be provided to receive interleaf sheet 1104 as it exits egress chute 918.

Figure 11A:
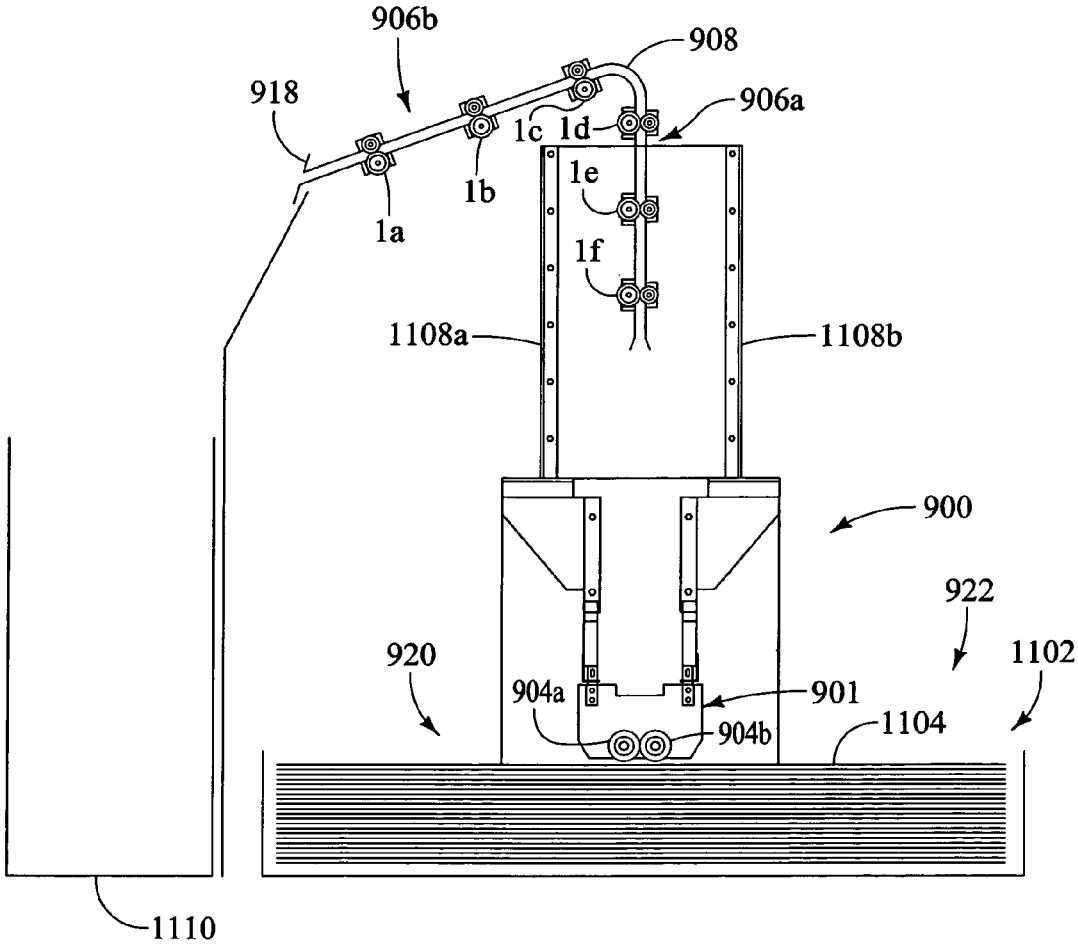
FIGS. 11A–11D is a sequence of operations showing how a second embodiment of the interleaf sheet removal apparatus can be used to pick up an interleaf sheet.
Figure 11B:
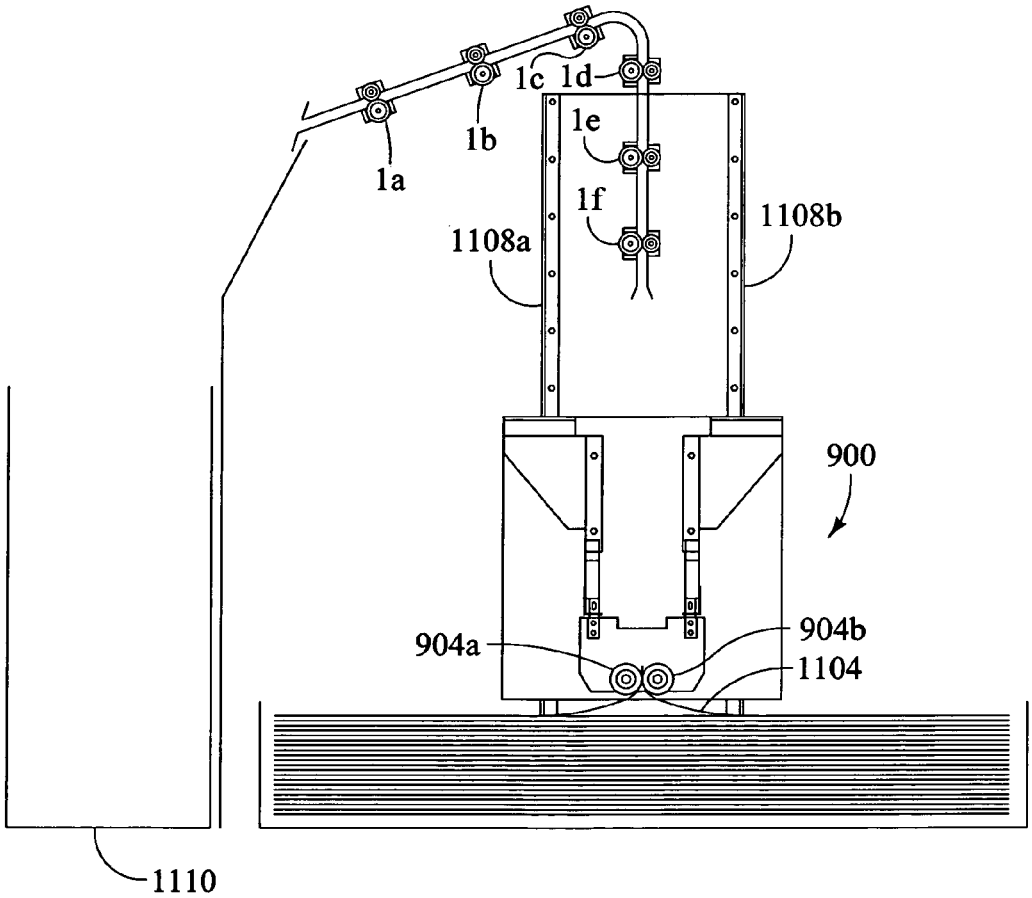

As shown in FIG. 11B, interleaf sheet 1104 is lifted off the plate stack by rotating rollers 904*a*, 904*b*. Interleaf sheet 1104 can be folded, and pulled up between rollers 904*a*, 904*b*. Rollers 904*a*, 904*b* can be stopped when a predetermined length of interleaf sheet 1104 has been fed therethrough. A sensor (not shown) can be used to indicate the predetermined length. For example, an optical sensor can be mounted above rollers 904*a*, 904*b* such that when interleaf sheet 1104 is fed through rollers 904*a*, 904*b*, interleaf sheet 1104 will interrupt the optical circuit, thereby indicating the predetermined length.

Figure 11C:
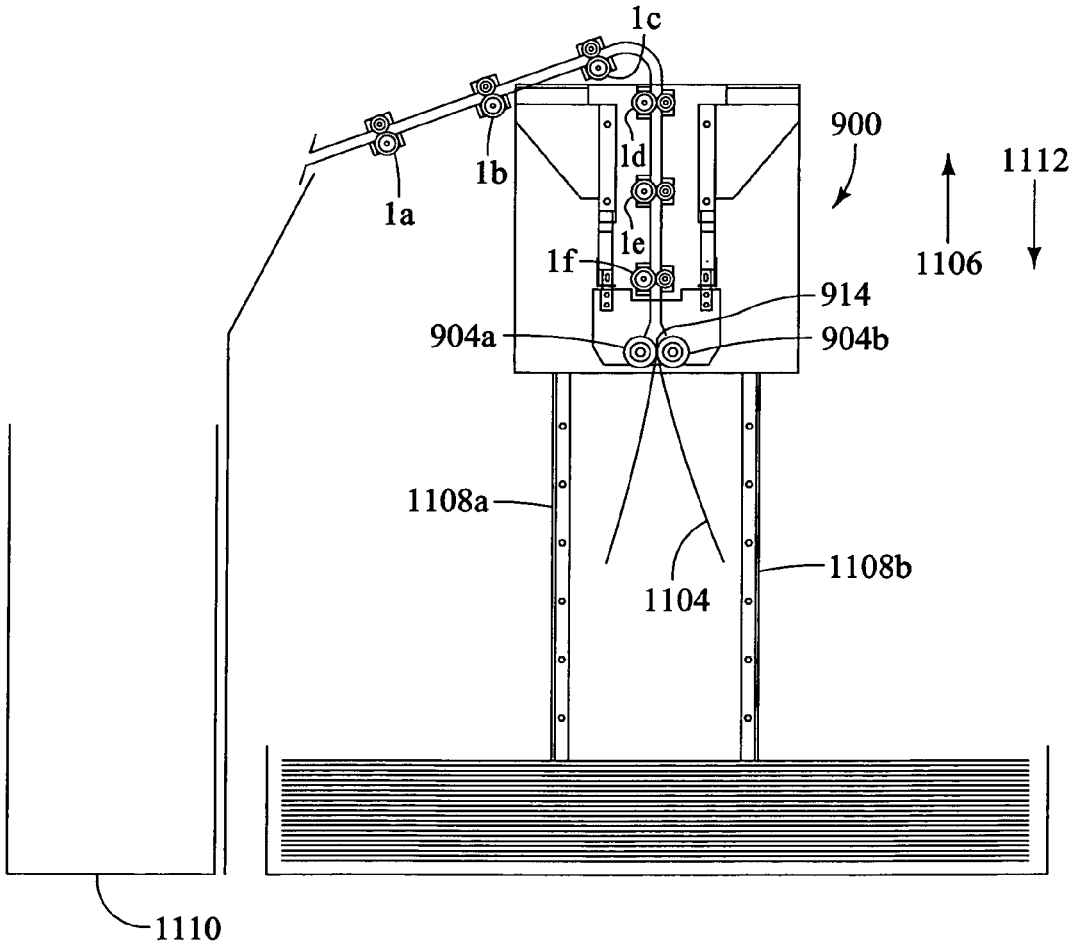

FIG. 11C shows that interleaf sheet 1104 is removed from stack 1102 as interleaf sheet removal apparatus 900 traverses rails 1108*a*, 1108*b* in the direction of arrow 1106. Rollers 904*a*, 904*b* feed the leading edge of interleaf sheet 1104 to opening 914.

Figure 11D:
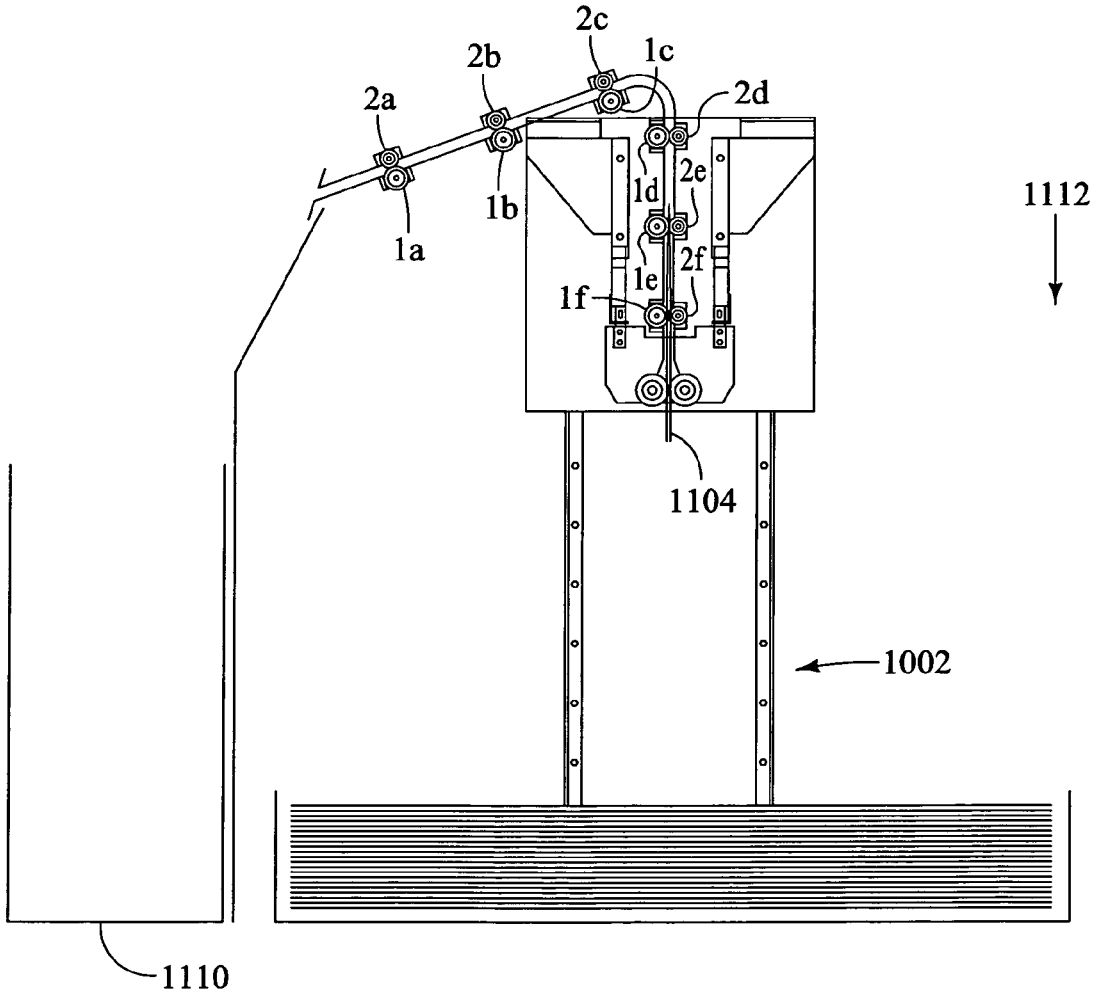

FIG. 11D shows interleaf sheet 1104 being driven by rollers 1*a*–1*f*, in conjunction with rollers 2*a*–2*f* to convey interleaf sheet 1104 through transfer housing 906*a*, connection housing 908, and transfer housing 906*b*. Rollers 1*a*–1*f* and 2*a*–2*f* can continue to rotate until a trailing edge of interleaf sheet 1104 has cleared rollers 1*a*, 2*a*. A sensor, such as an optical sensor, positioned at or near rollers 1*a*, 2*a*, can be used to indicate when the sheet has cleared. As the trailing edge of interleaf sheet 1104 exits rollers 1*a*, 2*a*, interleaf sheet 1104 can be placed into disposal bin 1110. Interleaf sheet removal apparatus 900 can then move in the direction of arrow 1112, to return to the position shown in FIG. 11A, and receive another interleaf sheet 1104.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention. While the foregoing invention has been described in detail by way of illustration and example of preferred embodiments, numerous modifications, substitutions, and alterations are possible without departing from the scope of the invention defined in the following claims.

What is claimed is:

1. An apparatus for lifting at least one of a sheet of paper and a paper-like sheet, comprising:

a first X-shaped member comprising a first beam and a second beam of substantially equal length rotatably connected to each other;

a second X-shaped member comprising a first beam and a second beam of substantially equal length rotatably connected to each other;

a rod having opposing ends respectively connected to said first and second X-shaped members;

a first roller having an axle extending therethrough, wherein opposing ends of the axle contact the first beams;

a second roller having an axle extending therethrough, wherein opposing ends of the axle contact the second beams;

a first connecting rod having opposing ends that contact the first beams;

a second connecting rod having opposing ends that contact the second beams; and at least one spring connected to said first and second connecting rods, said at least one spring providing a pinch force holding a surface of said first and second rollers in contact in an equilibrium position;

wherein said first and second rollers rotate about their respective axles when moving apart from each other, and do not rotate about their respective axles when moving towards each other, the non-movement of said first and second rollers providing a friction force with respect to the sheet, causing a portion of the sheet to be interposed between roller surfaces when said first and second rollers return to the equilibrium position.

2. The apparatus according to claim 1, further comprising a push rod contacting said rod, wherein movement of said push rod in a downward direction causes said rollers to move apart from each other.

3. The apparatus according to claim 1, wherein said first and second rollers comprise clutch bearings to prevent rotation of said first and second rollers when said first and second rollers are moving towards each other.

4. The apparatus according to claim 1, wherein said X-shaped members are connected to each other at a mid-section thereof.

5. An apparatus for lifting at least one of a sheet of paper and a paper-like sheet, comprising:

a first X-shaped member comprising a first beam and a second beam of substantially equal length rotatably connected to each other;

a second X-shaped member comprising a first beam and a second beam of substantially equal length rotatably connected to each other;

a rod having opposing ends respectively connected to said first and second X-shaped members;

a roller having an axle extending therethrough, wherein opposing ends of the axle are connected to the first beams;

a block interposed between each of the second beams;

a first connecting rod having opposing ends that respectively contact the first beams;

a second connecting rod having opposing ends that respectively contact the second beams;

at least one spring connected to said first and second connecting rods, said at least one spring providing a pinch force holding a surface of said roller in contact with a surface of said block proximate said roller in an equilibrium position;

wherein said roller rotates about the axle when moving away from said block, and does not rotate about the axle when moving towards said block, the non-rotation of said roller providing a friction force with respect to the sheet, causing a portion of the sheet to be interposed between said roller and the surface of said block proximate said roller when said roller returns to the equilibrium position.

6. The apparatus according to claim 5, further comprising a rod extending through said block structure, wherein opposing ends of the rod respectively contact the second beams.

7. The apparatus according to claim 5, further comprising a push rod contacting said rod, wherein movement of said push rod in a downward direction causes said roller to move away from said block.

8. The apparatus according to claim 7, wherein said roller comprises clutch bearings to prevent rotation of said roller when said roller-moves toward said block.

9. The apparatus according to claim 5, wherein said X-shaped members are connected to each other at a mid-section thereof.

10. The apparatus according to claim 5, wherein said block comprises a recess on a face of said block proximate said roller.

* * * * *